US008257230B2

(12) United States Patent
Chen et al.

(10) Patent No.: US 8,257,230 B2
(45) Date of Patent: Sep. 4, 2012

(54) ELLIPTICAL TRAINER HAVING TWO CRANK ASSEMBLIES

(75) Inventors: Chih-Liang Chen, Pateh (TW); Chao-Chi Yu, Taichung (TW)

(73) Assignee: Zhongshan Yingliang Health Technology Co., Ltd., Zhongshan, Guangdong Province (CN)

( * ) Notice: Subject to any disclaimer, the term of this patent is extended or adjusted under 35 U.S.C. 154(b) by 78 days.

(21) Appl. No.: 12/930,021

(22) Filed: Dec. 23, 2010

(65) Prior Publication Data

US 2012/0165160 A1 Jun. 28, 2012

(51) Int. Cl.
*A63B 22/04* (2006.01)

(52) U.S. Cl. ..... 482/52; 482/51; 482/67; 482/57

(58) Field of Classification Search ..... 482/51–53, 482/57, 70, 79–80
See application file for complete search history.

(56) References Cited

U.S. PATENT DOCUMENTS 7,854,691 B2 * 12/2010 Long et al. ..... 482/57
7,909,740 B2 * 3/2011 Dalebout et al. ..... 482/52
7,942,787 B2 * 5/2011 Ohrt et al. ..... 482/52

* cited by examiner

*Primary Examiner* — Glenn Richman
(74) *Attorney, Agent, or Firm* — Charles E. Baxley

(57) ABSTRACT

An elliptical trainer has a base, and two crank assemblies, a handle assembly and a linkage assembly mounted on the base. Each crank assembly has two cranks and a transmission wheel. A transmission strip is mounted around the transmission wheels of the crank assemblies to simulate rotations of the crank assemblies. The linkage assembly connects the cranks of the crank assemblies to the handle assembly. When the elliptical trainer is operated, the linkage assembly drives the cranks to alternately rotate upwardly and downwardly. The cranks that rotate downwardly drag the other cranks to rotate upwardly. Therefore, the crank assemblies and the linkage assembly operate smoothly, and consequently, the user is capable of smoothly performing walking or running movements.

9 Claims, 5 Drawing Sheets

ELLIPTICAL TRAINER HAVING TWO CRANK ASSEMBLIES

BACKGROUND OF THE INVENTION

1. Field of the Invention

The present invention relates to an elliptical trainer, especially to an elliptical trainer that has two crank assemblies and allows a user to perform smooth movements.

2. Description of the Prior Art(s)

An elliptical trainer is a stationary exercise machine that simulates walking or running without causing excessive pressure to the knee joints and decreases the risk of impact injuries. The elliptical trainer offers a non-impact cardiovascular workout, capable of varying from low to high intensity based on a resistance preference set by users.

A conventional elliptical trainer has a base, a flywheel, a handle assembly, two linkage assemblies and a resistance assembly. The flywheel and the handle assembly are separately mounted'rotatably on the base. The linkage assemblies are respectively mounted on two'opposite sides of the base and connect pivotally to the handle assembly and eccentrically to the flywheel. Each linkage assembly has multiple links pivotally connecting to each other in series. The resistance assembly applies resistance to the flywheel. When the conventional elliptical trainer is operated, the linkage assemblies rotate the flywheel. However, as the links of the linkage assemblies swing or rotate, one or more toggle positions exist so that the linkage assemblies and the flywheel do not operate smoothly. Consequently, the conventional elliptical trainer is not able to smoothly simulate the walking or running movements.

To overcome the shortcomings, the present invention provides an elliptical trainer having two crank assemblies to mitigate or obviate the aforementioned problems.

SUMMARY OF THE INVENTION

The main objective of the present invention is to provide an elliptical trainer having two crank assemblies. The elliptical trainer has a base, and two crank assemblies, a handle assembly and a linkage assembly mounted on the base. Each crank assembly has two cranks and a transmission wheel. A transmission strip is mounted around the transmission wheels of the crank assemblies to simulate rotations of the crank assemblies. The linkage assembly connects the cranks of the crank assemblies to the handle assembly.

When the elliptical trainer is operated, the linkage assembly drives the cranks to alternately rotate upwardly and downwardly. The cranks that rotate downwardly drag the other cranks to rotate upwardly. Therefore, the crank assemblies and the linkage assembly operate smoothly, and consequently, the user is capable of smoothly performing walking or running movements.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
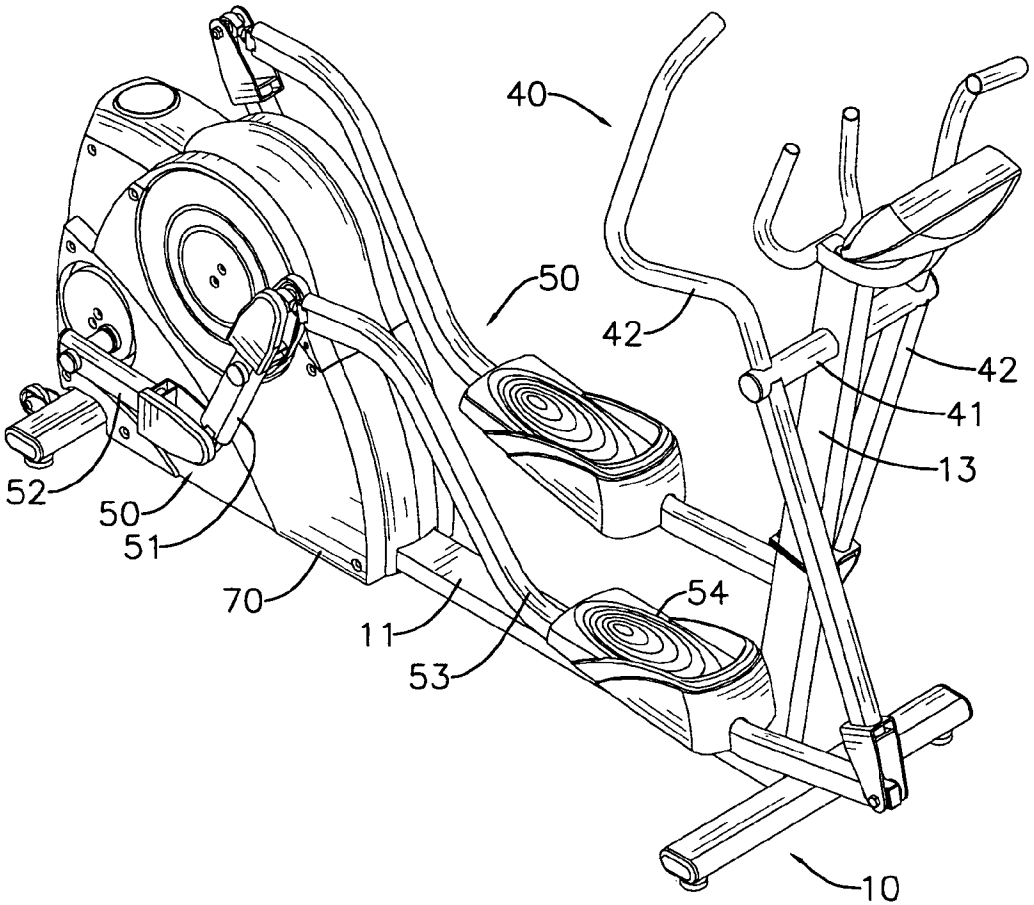
FIG. 1 is a perspective view of an elliptical trainer having two crank assemblies in accordance with the present invention.
Figure 2:
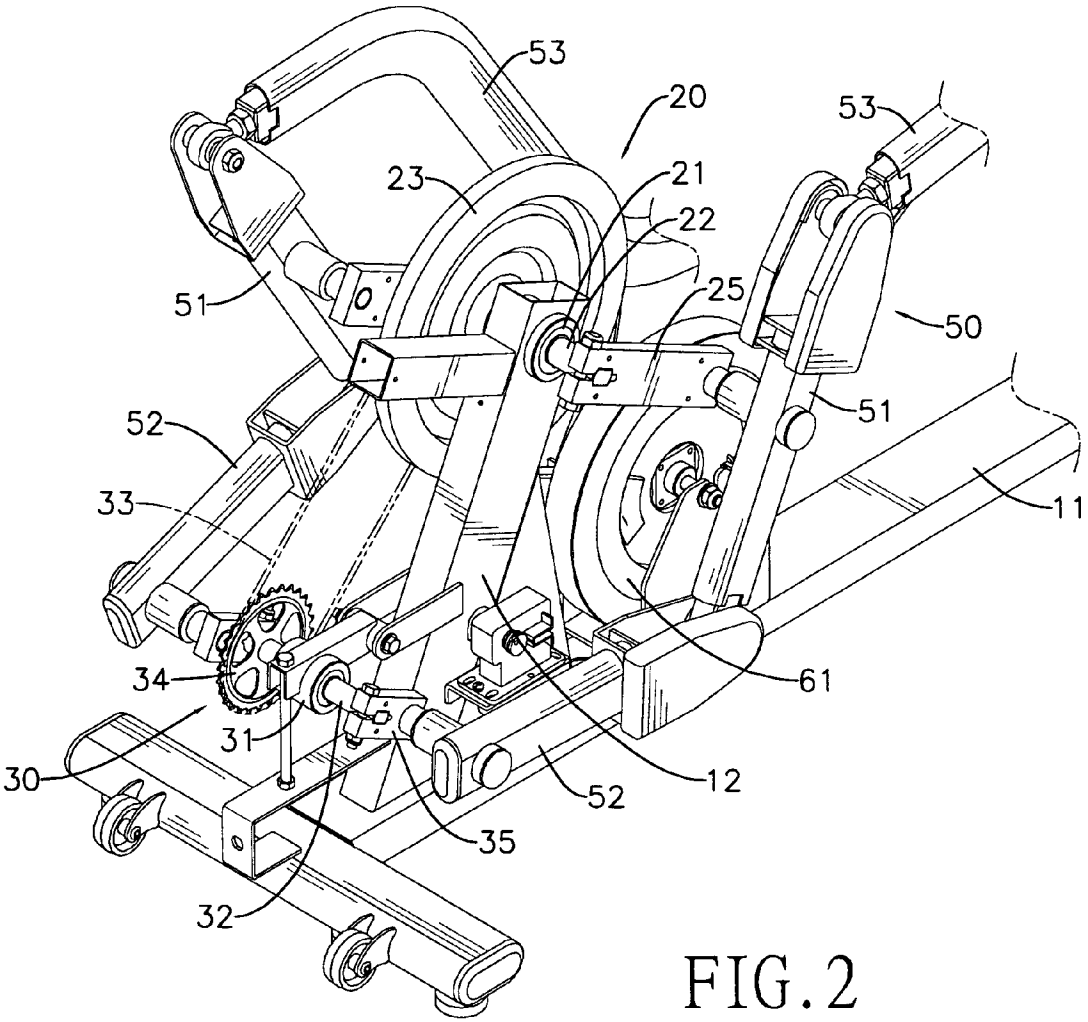
FIG. 2 is an enlarged rear perspective view of the elliptical trainer in FIG. 1.
Figure 3:
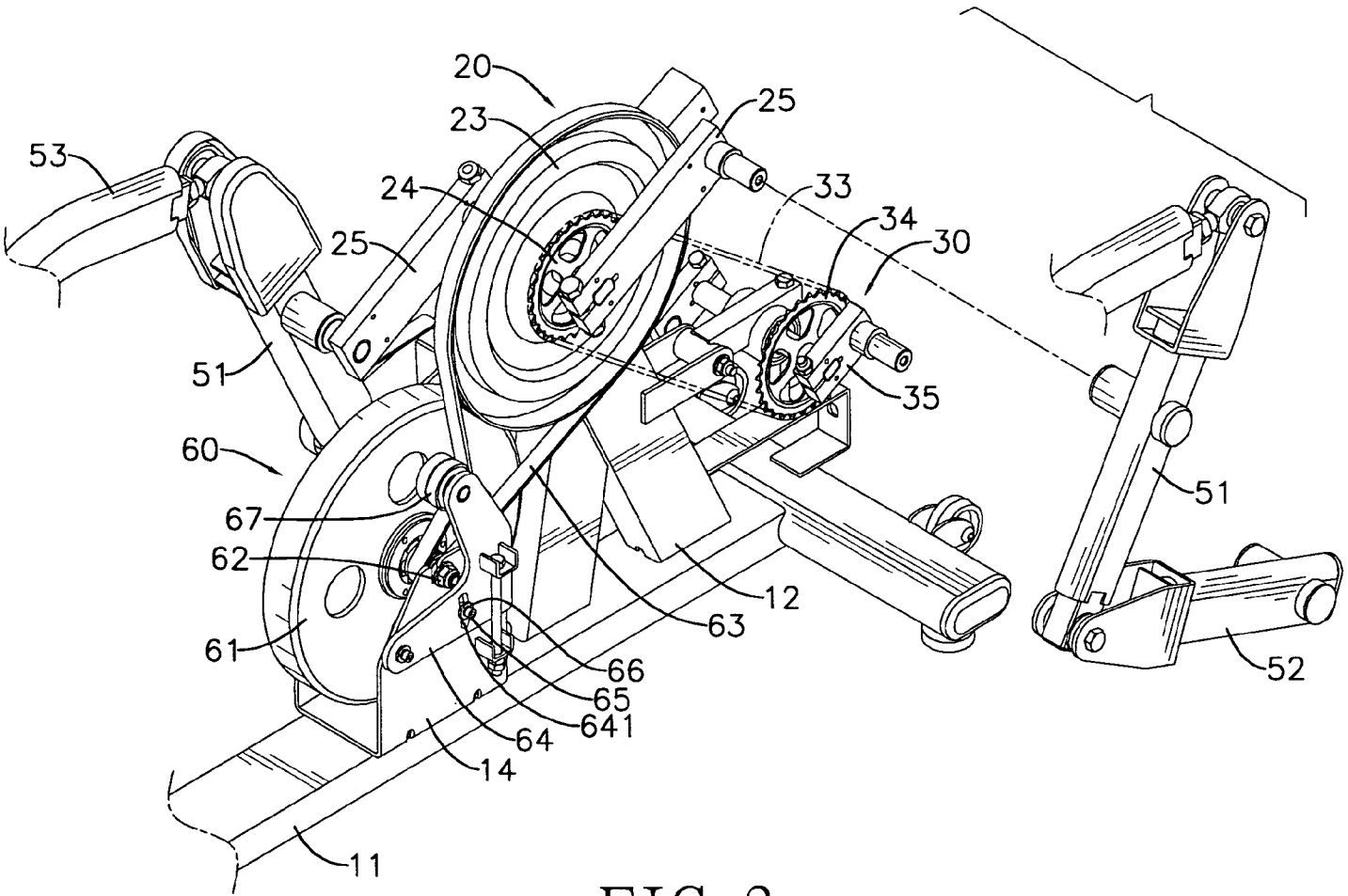
FIG. 3 is an enlarged exploded perspective view of the elliptical trainer in FIG. 1.

With reference to FIGS. 1 to 3, an elliptical trainer having two crank assemblies in accordance with the present invention comprises a base 10, a first crank assembly 20, a second crank assembly 30, a handle assembly 40, a linkage assembly 50, a resistance assembly 60 and a casing 70.

The base 10 is placed on a plane and has a bottom frame 11, a crank support 12, a handle support 13 and a mounting bracket 14. The crank support 12 and the handle support 13 are mounted separately on and protrude up from the bottom frame 11. The mounting bracket 14 is mounted on the bottom frame 11 and is disposed beside the crank support 12.

The first crank assembly 20 is mounted rotatably on the crank support 12 and has a first bearing 21, a first axle 22, a flywheel 23, a first transmission wheel 24 and two first cranks 25. The first bearing 21 is mounted in the crank support 12. The first axle 22 is mounted pivotally through the crank support 12, is mounted pivotally through the first bearing 21 and has two opposite ends. The flywheel 23 is mounted securely around one of the ends of the first axle 22. The first transmission wheel 24 is mounted securely around one of the ends of the first axle 22 such that the flywheel 23 and the first transmission wheel 24 rotate simultaneously with the first axle 22. The first cranks 25 are respectively mounted securely on the ends of the first axle 22 and extend perpendicularly to the first axle 22. Each first crank 25 has a distal end and a proximal end. The proximal end of the first crank 25 is mounted securely on a corresponding end of the first axle 22.

The second crank assembly 30 is mounted rotatably on the crank support 12 and has a second bearing 31, a second axle 32, a second transmission wheel 34, a transmission strip 33 and two second cranks 35. The second bearing 31 is mounted in the crank support 12. The second axle 32 is mounted pivotally through the crank support 12, is mounted pivotally through the second bearing 31 and has two opposite ends. The second transmission wheel 34 is mounted securely around one of the ends of the second axle 32 and corresponds to the first transmission wheel 24. The transmission strip 33 is looped around the first and second transmission wheels 24, 34. Preferably, the first and second transmission wheels 24, 34 are sprockets and the transmission strip 33 is a roller chain. Thus, as the first transmission wheel 24 rotates, the second transmission wheel 34 rotates simultaneously. The second cranks 35 are respectively mounted securely on the ends of the second axle 32 and extend perpendicularly to the second axle 32. Each second crank 35 has a distal end and a proximal end. The proximal end of the second crank 35 is mounted securely on a corresponding end of the second axle 32.

The handle assembly 40 is mounted pivotally on the handle support 13 and has a connecting shaft 41 and two handles 42. The connecting shaft 41 is transversely mounted pivotally through the handle support 13 and has two opposite ends. The handles 42 are respectively and longitudinally mounted pivotally on the handle support 13 and are respectively mounted securely on the ends of the connecting shaft 41. Each handle 42 has a lower end.

The linkage assembly 50 connects the first and second crank assemblies 20, 30 to the handle assembly 40, and has two first links 51, two second links 52, two transmission links 53 and two footrests 54.

The first links 51 are respectively mounted pivotally on the distal ends of the first cranks 25. Each first link 51 has a front end, a rear end and a pivot. The pivot of the first link 51 is defined between the front and rear ends of the first link 51 and is mounted pivotally on the distal end of a corresponding first crank 25.

The second links 52 are respectively mounted pivotally on the distal ends of the second cranks 35, and pivotally and respectively connect to the first links. Each second link 52 has a front end and a pivot. The front end of the second link 52 pivotally connects to the rear end of a corresponding first link 51. The pivot of the second link 52 is defined as separated from the front end of the second link 52 and is mounted pivotally on the distal end of a corresponding second crank 35.

The transmission links 53 pivotally and respectively connect the first links 51 to the handles 42. Each transmission link 53 has a front end and a rear end. The front end of the transmission link 53 pivotally connects to the lower end of a corresponding handle 42. The rear end of the transmission link 53 pivotally connects to the front end of a corresponding first link 51.

The footrests 54 are respectively mounted on the transmission links 53.

The resistance assembly 60 is mounted on the mounting bracket 14 and has a magnetic wheel 61, a pivot shaft 62, a belt 63, an adjusting bracket 64, a guiding pin 65, a fastener 66 and a roller 67. The magnetic wheel 61 is mounted on the mounting bracket 14. The pivot shaft 62 is mounted through the mounting bracket 14 and is mounted pivotally through the magnetic wheel 61. The belt 63 is looped around the flywheel 23 and the pivot shaft 62, and has an outer surface. The adjusting bracket 64 is mounted on the mounting bracket 14 and has a distal end, a proximal end and a guiding slot 641. The proximal end of the adjusting bracket 64 is mounted pivotally on the mounting bracket 14. The guiding slot 641 is formed through the adjusting bracket 64. The guiding pin 65 is mounted through the guiding slot 641 of the adjusting bracket 64 and is attached to the mounting bracket 14. The fastener 66 is mounted on the guiding pin 65 and selectively holds the adjusting bracket 64 to prevent the adjusting bracket 64 from pivoting. The roller 67 is mounted rotatably on the distal end of the adjusting bracket 64 and presses against the outer surface of the belt 63 to damp a rotation of the flywheel 23. Furthermore, releasing the fastener 66 to pivot the adjusting bracket 64 loosens the belt 63 or presses against the belt 63 more tightly. Thus, resistance applied to the flywheel 23 and workout intensity that a user sustains are adjusted.

The casing 70 is mounted on and covers the first and second crank assemblies 20, 30 and the resistant assembly 60.

Figure 4:
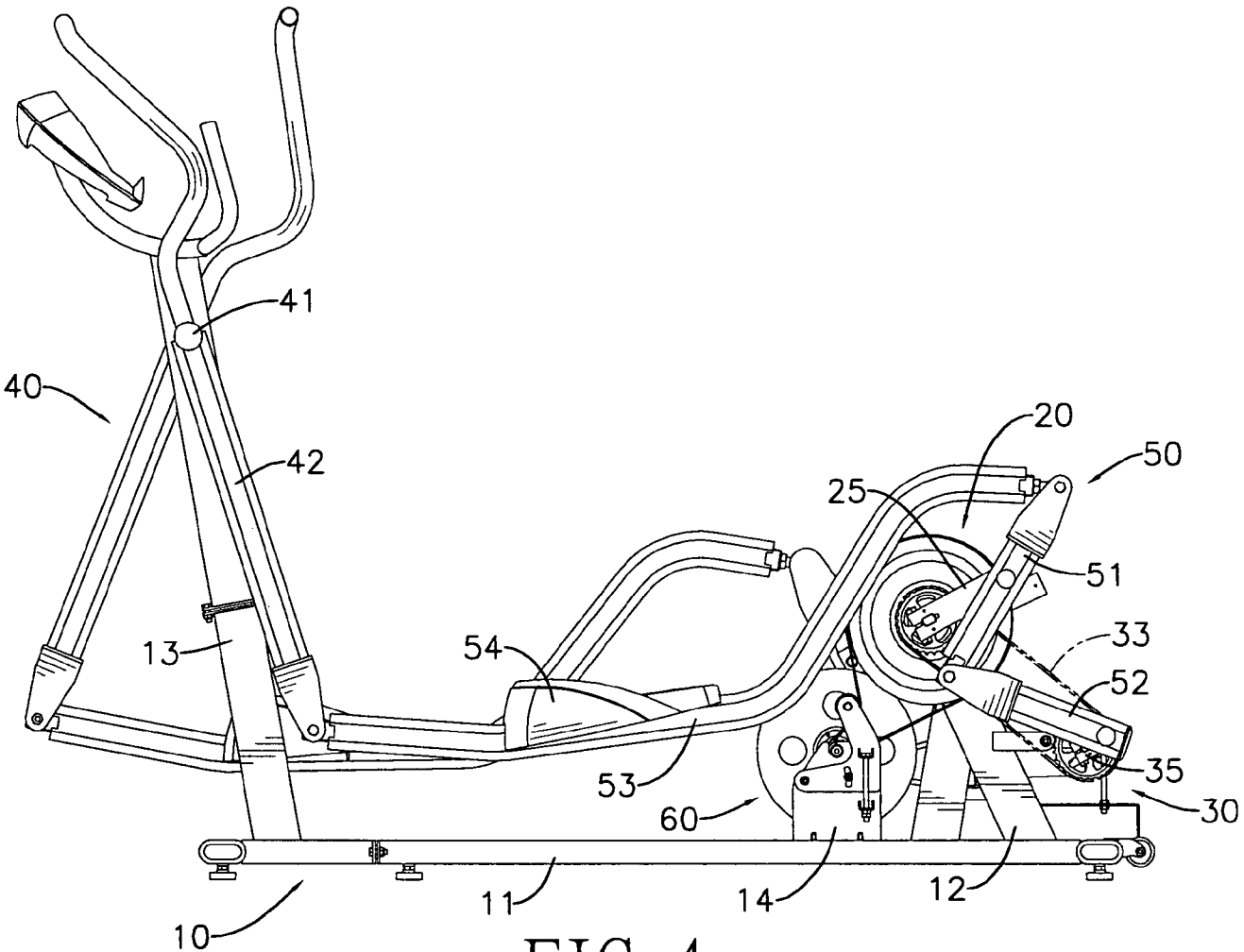
FIG. 4 is a side view of the elliptical trainer in FIG. 1.
Figure 5:
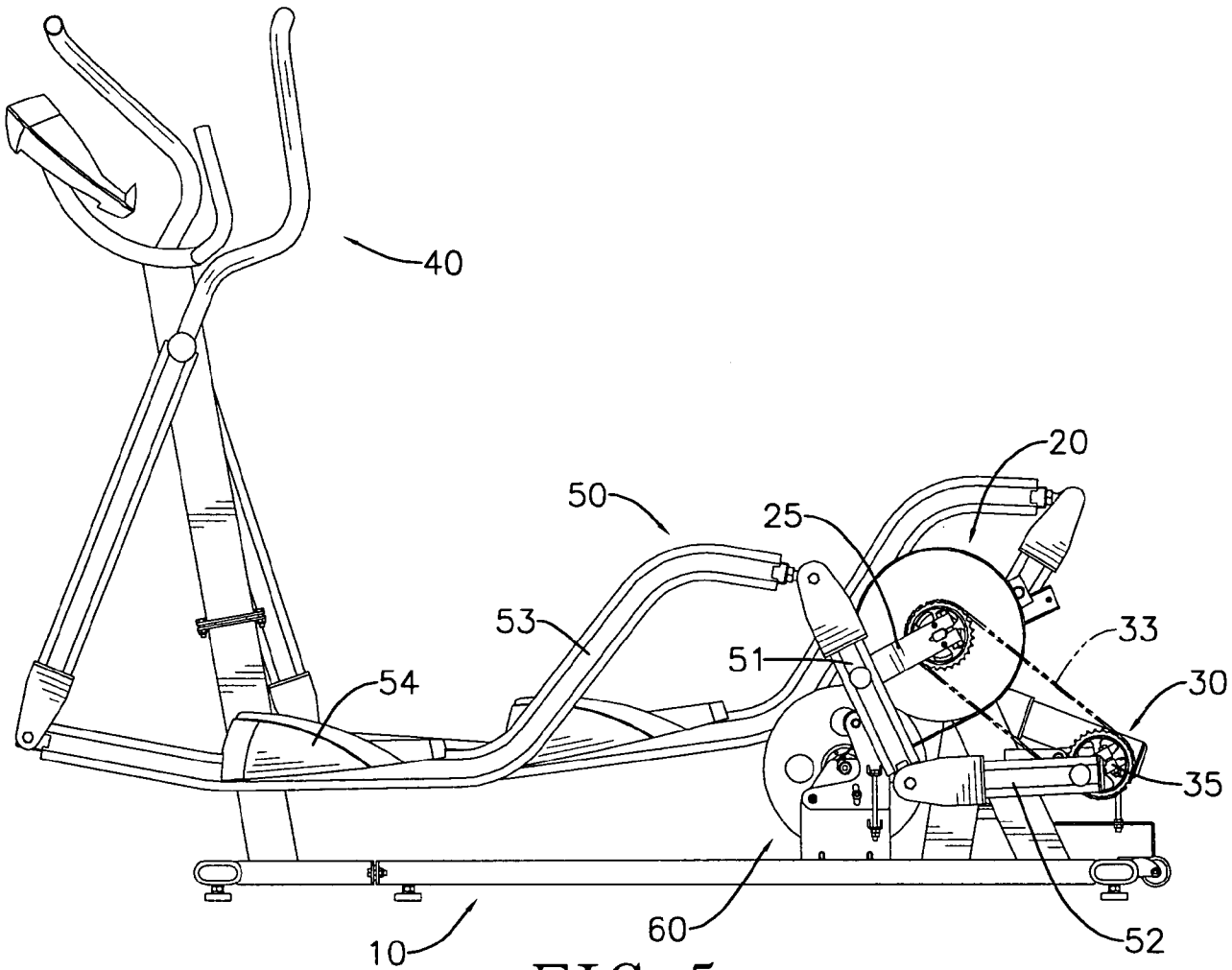
FIG. 5 is an operational side view of the elliptical trainer in FIG. 1.

The elliptical trainer having two crank assemblies as described has the following advantages. With further reference to FIGS. 4 and 5, when the elliptical trainer is operated, the linkage assembly 50 drives the first and second cranks 25, 35 to alternately rotate upwardly and downwardly. One of the first cranks 25 and one of the second cranks 35 that rotate downwardly drag the other one of the first cranks 25 and the other one of the second cranks 35 to rotate upwardly through the first and second transmission wheels 24, 34 and the transmission strip 33. Therefore, the first and second crank assemblies 20, and the linkage assembly 50 operate smoothly, and consequently, the user is capable of smoothly performing walking or running movements.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An elliptical trainer comprising
- a base having
  - a bottom frame;
  - a crank support and a handle support mounted separately on and protruding up from the bottom frame;
- a first crank assembly mounted rotatably on the crank support and having
  - a first axle mounted pivotally through the crank support and having two opposite ends;
  - a first transmission wheel mounted securely around one of the ends of the first axle; and
  - two first cranks respectively mounted securely on the ends of the first axle and extending perpendicularly to the first axle, and each first crank having
    - a distal end; and
    - a proximal end mounted securely on a corresponding end of the first axle;
- a second crank assembly mounted rotatably on the crank support and having
  - a second axle mounted pivotally through the crank support and having two opposite ends;
  - a second transmission wheel mounted securely around one of the ends of the second axle and corresponding to the first transmission wheel;
  - a transmission strip being looped around the first and second transmission wheels; and
  - two second cranks respectively mounted securely on the ends of the second axle and extending perpendicularly to the second axle, and each second crank having
    - a distal end; and
    - a proximal end mounted securely on a corresponding end of the second axle;
- a handle assembly mounted pivotally on the handle support and having two handles respectively and longitudinally mounted pivotally on the handle support; and
- a linkage assembly connecting the first and second crank assemblies to the handle assembly, and having
  - two first links respectively mounted pivotally on the distal ends of the first cranks;
  - two second links respectively mounted pivotally on the distal ends of the second cranks, and pivotally and respectively connecting to the first links; and
  - two transmission links pivotally and respectively connecting the first links to the handles.

2. The elliptical trainer as claimed in claim 1, wherein
- each handle of the handle assembly has a lower end;
- each first link of the linkage assembly has
  - a front end;
  - a rear end; and
  - a pivot defined between the front and rear ends of the first link and mounted pivotally on the distal end of a corresponding first crank;
- each second link of the linkage assembly has
  - a front end pivotally connecting to the rear end of a corresponding first link; and a pivot defined as separated from the front end of the second link and mounted pivotally on the distal end of a corresponding second crank; and each transmission link of the linkage assembly has a front end pivotally connecting to the lower end of a corresponding handle; and a rear end pivotally connecting to the front end of a corresponding first link.

3. The elliptical trainer as claimed in claim 2, wherein the base further has a mounting bracket mounted on the bottom frame and disposed beside the crank support;

the first crank assembly further has a flywheel mounted securely around one of the ends of the first axle; and the elliptical trainer further has a resistance assembly mounted on the mounting bracket and has a magnetic wheel mounted on the mounting bracket;

a pivot shaft mounted through the mounting bracket and mounted pivotally through the magnetic wheel; and a belt being looped around the flywheel and the pivot shaft.

4. The elliptical trainer as claimed in claim 3, wherein the resistance assembly further has an adjusting bracket mounted on the mounting bracket and having a distal end;

a proximal end mounted pivotally on the mounting bracket; and a guiding slot formed through the adjusting bracket;

a guiding pin mounted through the guiding slot of the adjusting bracket and attached to the mounting bracket;

a fastener mounted on the guiding pin and selectively holding the adjusting bracket; and a roller mounted rotatably on the distal end of the adjusting bracket and pressing against an outer surface of the belt.

5. The elliptical trainer as claimed in claim 4, wherein the first and second transmission wheels are sprockets and the transmission strip is a roller chain.

6. The elliptical trainer as claimed in claim 5, wherein the first crank assembly further has a first bearing mounted in the crank support;

the first axle of the first crank assembly is mounted pivotally through the first bearing;

the second crank assembly further has a second bearing mounted in the crank support; and the second axle of the second crank assembly is mounted pivotally through the second bearing.

7. The elliptical trainer as claimed in claim 6, wherein the handle assembly further has a connecting shaft transversely mounted pivotally through the handle support and having two opposite ends; and the handles of the handle assembly are respectively mounted on the ends of the connecting shaft.

8. The elliptical trainer as claimed in claim 7, wherein the linkage assembly further has two footrests respectively mounted on the transmission links.

9. The elliptical trainer as claimed in claim 8 further having a casing mounted on and covering the first and second crank assemblies and the resistant assembly.

* * * * *